United States Patent [19]

Erickson

[11] Patent Number: 4,560,163

[45] Date of Patent: Dec. 24, 1985

[54] HOCKEY GAME

[76] Inventor: Gordon Erickson, P.O. Box 1096, Salmon Arm, British Columbia, Canada

[21] Appl. No.: 712,200

[22] Filed: Mar. 15, 1985

[51] Int. Cl.[4] ..... A63B 67/04; A63F 7/06

[52] U.S. Cl. ..... 273/85 R

[58] Field of Search ..... 273/85 R, 118

[56] References Cited

U.S. PATENT DOCUMENTS

| | | | |
|---|---|---|---|
| 1,593,421 | 7/1926 | Blum | 273/85 R |
| 1,819,932 | 8/1931 | Walden | 273/85 R |

FOREIGN PATENT DOCUMENTS

| | | | |
|---|---|---|---|
| 211511 | 9/1940 | Switzerland | 273/85 R |
| 336188 | 8/1930 | United Kingdom | 273/85 R |

OTHER PUBLICATIONS

The New York Times 12-11-1966, p. 525, Hockey Game of Fun.

Reader's Digest Assoc., Inc. Book of 1000 Family Games, pp. 228-229, Box Hockey.

*Primary Examiner*—Paul E. Shapiro

*Attorney, Agent, or Firm*—D. R. Morrison

[57] ABSTRACT

A hockey game for use with a ball or disk including a planar deck, a pair of perimeter side walls along respective opposed long side edges of the deck, and a pair of perimeter end walls along respective opposed short end edges of the deck. Each end wall has a goal opening therein extending down to the deck surface. A plurality of substantially parallel spaced apart blocking walls extend across the deck from one perimeter side wall to the other. Each blocking wall has openings therein extending down to the deck surface and being sufficiently high and wide to permit passage therethrough of the ball or disk. Selected openings are aligned along substantially parallel lines of sight from one perimeter end wall to the other with the width of the openings in the blocking walls gradually decreasing from the center of the deck towards either perimeter end wall.

7 Claims, 2 Drawing Figures

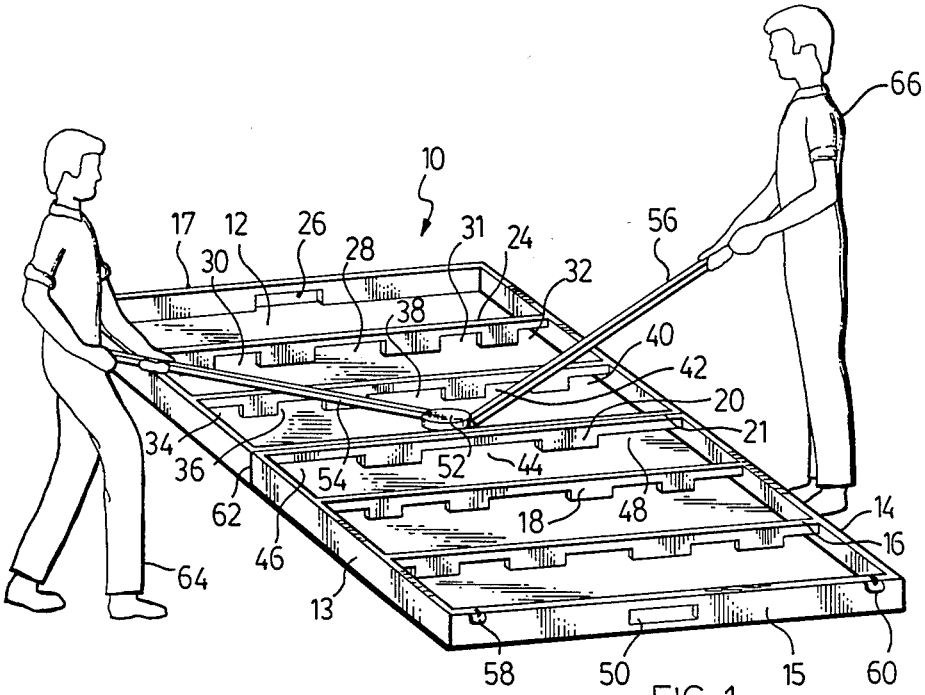
FIG. 1.
FIG. 2.
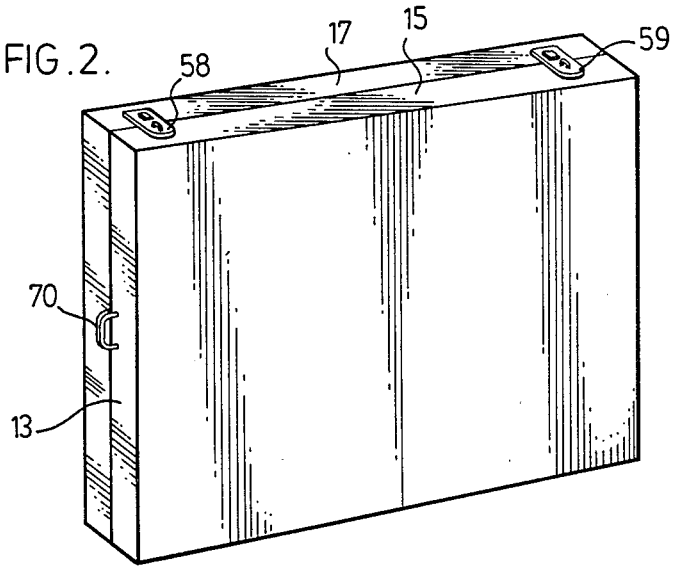

HOCKEY GAME

BACKGROUND OF THE INVENTION

The present invention relates to a hockey game to be played with sticks and a ball or disk.

Previously known hockey games have been of a type in which robot players with sticks are pivotally mounted on a playing surface at selected locations thereover. A hockey puck or disk is propelled by pulling one of several levers coupled to selected robots to pivot a robot closest to the puck in order to propel it in a desired direction. Such a game involves relatively little physical exercise and only minimal value in respect of developing reflexes. Moreover, such games are renowed for breaking down due to the large number of movable parts.

There are also known games in which a disk is manually propelled over a smooth deck by one of two players located at each end of the deck and equipped with a bat. At each of the deck is located an opening through which a player must direct the disk. Thus, one player will hit the disk over the surface towards the opposite opening while the other player attempts to block the disk from entering the opening. Again, the foregoing game provides only minimal exercise valve and reflex training.

SUMMARY OF THE INVENTION

According to the invention there is provided a hockey game for use with a ball or disk which has a planar deck, a pair of perimeter side walls along respective opposed long side edges of the deck, and a pair of perimeter end walls along respective opposed short end edges of the deck. Each end wall has a goal opening therein extending down to the surface of the deck. A plurality of substantially parallel spaced apart blocking walls extend across the deck from one perimeter side wall to the other with each blocking wall having openings therein extending down to the deck surface and sufficiently high and wide to permit passage therethrough of the ball or disk. Selected openings are aligned along substantially parallel lines of sight from one perimeter end wall to the other with the width of the openings in the blocking walls gradually decreasing from the center of the deck towards either perimeter end wall.

By utilizing aligned openings it is possible for a pair of players to propel a disk from one end of the board to the other without depending on deflections through each of several openings in the blocking walls along the way. By providing for more than one set of holes aligned from one end of the deck to the other, it is possible to shoot the disk from one end of the deck to the other with an element of surprise. Moreover, it is also possible to play the disk off of the perimeter wall and deflect it through any one of a selected number of openings in more than one blocking wall. The structure of the holes in the blocking wall is particularly adapted to an active game which provides a relatively wide variety of possible plays by each of the players.

Preferably the deck is rectangular with the goal openings located at the perimeter end walls.

Advantageously, one set of the aligned openings is aligned with the goal openings, thereby providing the possibility of a shot from one end of the deck travelling all the way to the other end and entering the associated goal opening.

There may also be two sets of aligned openings adjacent respective perimeter side walls. The number of blocking walls may be five.

Preferably the deck is foldable about a line bisecting the length thereof. Thus, the deck may be placed on the floor of a room and following use folded into a relatively thin package for storage against a wall or other convenient place.

The perimeter and blocking walls may be wood in order to provide a combination of low cost of materials and ruggedness of structure. Since there are no moving parts in the above game, there is very little which can break on it except with unduly excessive force being applied by the user.

BRIEF DESCRIPTION OF THE DRAWINGS

In a drawings of a preferred embodiment of the invention,

FIG. 1 is a perspective view of the hockey game in use; and

FIG. 2 is a perspective view of the game folded for storage.

DETAILED DESCRIPTION WITH REFERENCE TO THE DRAWINGS

The preferred embodiment of the invention as illustrated in FIG. 1 includes a planar deck 12 having perimeter side walls 13 and 14 and perimeter end walls 15 and 17. Goal openings 26 and 50 are located intermediate end perimeter walls 17 and 15, respectively. The openings 26 and 50 extend down to the surface of deck 12.

There are five spaced apart substantially parallel blocking walls 16, 18, 20, 22 and 24 extending across perimeter side walls 13 and 14. Each of the blocking walls has a plurality of openings therein extending down to the surface of deck 12. The openings on center blocking wall 20 include a center opening 44 of a relatively large width and side openings 46 and 48 extending to perimeter side walls 13 and 14, respectively. Blocking walls 18 and 22 have a hole structure identical to each other with blocking wall 22 having a central opening 38, end openings 34 and 40 and intermediate openings 36 and 42. Opening 38 has a width which is shorter than that of opening 44 and openings 46 and 48 are longer than openings 34 and 40. Blocking walls 16 and 24 also have an opening structure identical to each other which includes a central opening 28 whose width is narrower than that of opening 38, intermediate openings 30 and 31 and end openings which include opening 32 and one at the opposite end of identical width. Opening 32 is narrower in width than opening 40.

Blocking wall 20 is actually formed into two separate parts, with a piano hinge 21 affixed to the top of each part. Perimeter walls 13 and 14 also are made in two parts, meeting at joint 62. Thus, the two halves of the hockey game are foldable about piano hinge 21 such that hooks 58 and 60 attached at one end can be engaged by corresponding locking latches (see FIG. 2) affixed to perimeter end wall 17.

The game is played generally by two players 64 and 66 with sticks 54 and 56, respectively and a hockey puck or disk 52. Each player attempts to hit the hockey puck or disk 52 through one or more of the blocking wall openings towards the opponents goal opening 26 or 50. The other player attempts to block any attempt by the opposing player to propel the disk 52 into his goal opening.

It is possible with the particular arrangement of blocking wall openings employed for a player to hit the disk 52 through three aligned openings 44, 38 and 28 and hit it into a goal opening 26. The same opportunity is available to the opposing player. Alternatively, a player could hit the disk through an opening 44 and into an intermediate opening 42 through an end opening 32 of blocking wall 24, bounce it off of the side perimeter wall 14 and direct it towards the goal opening 26. With the disk 52 between walls 20 and 22, a player could also direct the disk 52 through opening 38 and against one edge of intermediate opening 24 so that the disk 52 rebounds into the goal opening 26. Alternatively, a player could direct the disk 52 through intermediate goal openings 36 or 42, rebound it off of an edge of central opening 28 and into goal opening 26. It will also be appreciated that there are a great many possible moves available to a player in view of the particular widths and arrangements of blocking wall openings employed. The game is generally played with hockey sticks 54 and 56 having no widened end portion as does a normal hockey stick. By using such sticks, players are forced to develop a great deal of speed and to rely on their reflexes. The game when played is an extremely active one, generating considerable energy and developing a high degree of cardiovascular activity.

Other variations, modifications and departures lying with the spirit of the invention and scope as defined by the appended claims will be obvious to those skilled in the art.

I claim:

1. A hockey game for use with a ball or disk, comprising:

(a) a planar deck (b) a pair of perimeter side walls along respective opposed long side edges of said deck;

(c) a pair of perimeter end walls along respective opposed short end edges of said deck, each end wall having a goal opening therein extending down to said deck;

(d) a plurality of substantially parallel spaced apart blocking walls extending across said deck from one perimeter side wall to the other, each blocking wall having openings therein extending down to said deck and sufficiently high and wide to permit passage therethrough of said ball or disk, and selected openings aligned along substantially parallel lines of sight from one perimeter end wall to the other with the width of said openings in said blocking walls gradually decreasing from the center of said deck towards either perimeter end wall.

2. A hockey game as defined by claim 1, wherein said deck is rectangular.

3. A hockey game as defined by claim 2, wherein one set of the aligned openings is aligned with the goal openings.

4. A hockey game as defined by claim 3, wherein two sets of aligned openings are adjacent respective side walls.

5. A hockey game as defined by claim 4, wherein the number of blocking walls is five.

6. A hockey game as defined by claim 5, wherein said deck is foldable about a line bisecting the length thereof.

7. A hockey game as defined by claim 5, wherein said perimeter and blocking walls are wood.

* * * * *